United States Patent [19]

Apikos

[11] 4,417,991

[45] Nov. 29, 1983

[54] GRAPHITED GEAR OILS

[75] Inventor: Dominic A. Apikos, Crown Point, Ind.

[73] Assignee: Atlantic Richfield Company, Philadelphia, Pa.

[21] Appl. No.: 418,135

[22] Filed: Sep. 15, 1982

[51] Int. Cl.[3] ..... C10M 1/10; C10M 1/28

[52] U.S. Cl. ..... 252/29; 252/22; 252/51.5 A; 252/32.7 E

[58] Field of Search ..... 252/22, 25, 29, 51.5 A, 252/32.7 E

[56] References Cited

U.S. PATENT DOCUMENTS

| | | | |
|---|---|---|---|
| 3,384,580 | 5/1968 | Peace | 252/29 |
| 4,094,799 | 6/1978 | DeVries et al. | 252/29 |
| 4,136,040 | 1/1979 | DeVries et al. | 252/29 |
| 4,144,166 | 3/1979 | DeJovine | 252/29 |

*Primary Examiner*—Jacqueline V. Howard

[57] ABSTRACT

Disclosed is a graphited gear oil containing extreme pressure additives, which significantly overcomes the increased tendency of graphite-containing compositions to thicken in use.

4 Claims, 4 Drawing Figures

Percent MPG Improvement at 7,500 Miles

Percent MPG Improvement at 15,000 Miles

Percent MPG Improvement at 7,500 Miles

Percent MPG Improvement at 15,000 Miles

GRAPHITED GEAR OILS

BACKGROUND OF THE INVENTION

Figure 1:
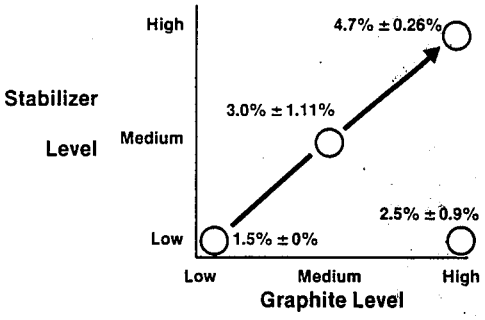

This invention is directed to graphite-containing lubricating compositions. More particularly, this invention is directed to energy efficient graphite-containing gear oil lubricating compositions.

Examples of lubricating compositions containing graphite are disclosed in the following U.S. patents. In U.S. Pat. No. 4,094,799 (June 13, 1978) of D. L. DeVries and J. M. DeJovine, an improved lubricating composition is disclosed which overcomes to a superior degree the tendency to form varnish, sludge and other similar deposits in the presence of solid lubricants dispersed in such compositions. The improvement was the result of employing at least one copolymer of (1) an N-vinyl pyrrolidone, and (2) an oil soluble acrylic ester. In view of intended end use in a modern internal combustion engine, other additives which may be included to impart particular properties to a lubricating composition were disclosed such as detergents, antioxidants, metal deactivators, pour point depressants, oiliness agents, blooming agents, and peptizing agents.

In U.S. Pat. No. 4,132,656 (Jan. 2, 1979) of D. L. DeVries and J. M. DeJovine, an improved lubricating oil composition provided to a surprising degree a reduction in detrimental deposit formations, e.g., on internal combustion engine components lubricated by such composition of the disclosed invention. The composition included certain nitrogen-containing polymers. The nitrogen-containing polymers consisted of a graft of dialkyl-aminoalkylmathacrylate to an oil soluble, substantially linear terpolymer. The terpolymer consisted of the reaction product of ethylene, a terminally unsaturated straight-chain alkene of 3 to about 12 carbons, and a terminally unsaturated nonconjugated alkadiene of 5 to about 8 carbons. The terpolymer had an average carbon chain length of about 700 to about 7,000 and an inherent viscosity of about 0.6 to about 1.9 at 0.10 weight percent solution in tetrachloroethylene at 30° C. Methods for preparing these dispersing agents are disclosed.

In U.S. Pat. No. 4,134,844 (Jan. 16, 1979) of D. L. DeVries and J. M. DeJovine, there is disclosed an improved lubricating composition which provides improved inhibition of sludge and varnish during use. The composition contained solid particles, preferably of graphite, along with other commonly used oil additives. Examples of such additives are conventional antioxidants, metal deactivators, pour point depressants, oiliness agents, blooming agents, and peptizing agents. A critical dispersing agent is added, which consists of the reaction product of an oxidized copolymer of ethylene and propylene with a formaldehyde-yielding reactant, and an aliphatic amine of polyamine. Suitable ethylene-propylene copolymers which are to be oxidized consist of disclosed reaction products of propylene, ethylene, aliphatic or cycloaliphatic radicals having a terminal double bond of from 2 to about 20 carbon atoms and a diolefin containing from 4 to about 25 carbon atoms. The diolefins may be either conjugated or nonconjugated diolefins. Methods for preparing the particular polymers of the critical dispersing agent are disclosed.

In U.S. Pat. No. 4,136,040 (Jan. 23, 1979) of D. L. DeVries and J. M. DeJovine, there is disclosed an improved lubricating composition which employs solid lubricants dispersed with the aid of a nitrogen-containing mixed ester of a carboxyl-containing interpolymer. The carboxyl-containing interpolymers include interpolymers of alpha, beta-unsaturated acids, or anhydrides. The reaction product of the carboxyl-containing interpolymer is then esterified, followed by a neutralization of the unesterified pendent carboxy acid groups with a polyamine. Preferred polyamino compounds include primary-aminoalkyl substituted tertiary amines, hetercyclic amines, and the like. The amino compounds may be aeromatic or alaphatic amines and are preferably heterocyclic amines such as aminoalkyl substituted morphylenes, piperyzenes, pyridines, and the like. The amines have from 4 to about 30 carbon atoms, preferably from about 4 to about 12 carbon atoms. Polar substituents such as halides of chlorine, bromine, ether, nitro, nitryl, and the like may be present.

Unfortunately, preparation of graphite-containing gear oils using the same graphite-containing concentrates useful in the preparation of lubricating oil compositions discussed hereinabove did not work particularly well. It was discovered that, due to differences in additive packages required for the use conditions of a gear oil as compared to that of an automotive crank case lubricating oil, there resulted a thickening of the gear oil in use. Example 1 of this application demonstrates that thickening occurred when a gear oil made with the same graphite-containing concentrates useful in the preparation of motor oil compositions discussed hereinabove was used in an automotive differential after only a few thousand miles. Also discussed in Example 1 is a process of agglomeration evidenced by a clumping or lumping together of graphite particles. As extreme pressure (EP) additive packages and dispersant additives both interact, both thickening and agglomeration occur in increasing amounts. With agglomeration, the more uniform film forming properties of dispersed graphite particles diminish. Decreasing film forming properties result in a lessening of the effectiveness of graphite for lubrication. Thickening due to oxidation of the base oil, however, can occur independently of any agglomeration.

By a gear oil composition in this specification is meant a composition suitable for lubricating gears that perform one or more of the following four functions: changing speed, transmitting power, changing rotational direction, and/or changing points of power transmitted. Gear lubricants are herein identified as falling within classification SAE J306C.

The requirements for a gear oil lubricating composition arise out of rolling and sliding motions that are present as gears interact and transmit power and changes in direction. These motions of rolling and sliding occur simultaneously and independently. To prevent failures, gear oil lubricants must provide a hydrodynamic wedge in low to medium contact pressures, e.g., less than about 30,000 pounds per square inch (psi), but require EP additives above 30,000 psi as the gear rotates in the presence of the lubricant. This wedge and EP film layer separate the teeth as the gears mesh. Increasing loads cause pressure contact zones of the gear lubricant to increase, thereby causing the EP film formed to be reduced in thickness. Failure results when both the hydrodynamic wedge and EP film fail to prevent contact between the meshing surfaces of the gears, which eventually results in wear.

To assure proper lubrication and extended service life, the following gear lubricant properties generally are required by substantially all gear lubricants. These properties are analyzed and determined by reference to standard ASTM tests. These properties are gravity, viscosity, viscosity index, flash point, chemical and thermal oxidative stability, anticorrosion tendencies, demulsibility, antifoaming tendencies, extreme pressure, pour point, and acid number. Gravity is the relative density which expresses the weight of a measured volume of product. Viscosity is the flow characteristic of a lubricant at a given temperature. Viscosity index is the empirical number indicating the effects of temperature changes on viscosity. Flash point is the lubricant's temperature, which gives off sufficient vapor to form a flammable mixture with air. Chemical and thermal oxidative stability is the amount of resistance of the lubricant to break down under heat in the presence of oxygen, thereby forming oxygen-containing products. Anticorrosion tendencies is the ability of a lubricant to protect against corrosion such as rust and some other forms of wear such as are observed when there are pits in tooth surfaces as a result of dissolving away portions of the gear. Demulsibility is the ability of a lubricant to separate from water under a given temperature. Antifoaming tendencies is the ability of a lubricant to avoid formation of foams. The tendency to foam is related to surface tension of the composition. Extreme pressure (EP) is a load bearing quality of the lubricant. Pour point is a low temperature property of the lubricant at which temperature the product congeals and gravity flow stops. Acid numbers measure the acidity of the lubricant.

The main difference between a lubricating oil composition of the above-cited patents suitable for use as an automobile lubricating crank case oil composition and a gear oil is the requirement placed upon the gear oil by the following: (1) very high pressures per unit area; (2) the presence of roll/slide contacting processes unique to meshing gears; and (3) the relatively longer use life of gear oils over simple lubricating oils.

The presence of an EP additive in a graphited gear oil has been found to result more readily in formation of either a sludge or agglomeration of the solid lubricating particles than in an automotive lubricating crank case oil. We have discovered a correlation between the amount of EP package breakdown and both agglomeration and thickening. This correlation is discussed and disclosed in Example 2.

Accordingly, there is a need to find stabilizers to be added to graphite-containing gear oil compositions that will inhibit the phenomena of thickening and/or agglomeration discussed hereinabove and in Example 1.

BRIEF DESCRIPTION OF THE INVENTION

It is an object of this invention to provide a gear oil composition containing graphite particles over about 90% thereof by weight, as based on the total weight of such graphite particles, which are below 1 micron in diameter and, preferably, over 95% thereof by weight which are below 1 micron in diameter, that does not thicken significantly or agglomerate before 50,000 miles and, preferably, not before 100,000 miles of use in the rear differential gear train of an automobile.

It is an object of this invention to provide a graphited gear oil which not only reduces friction and wear, but also is energy efficient, e.g., improves or increases miles per gallon for a particular blend of gasoline.

Other objects of this invention are clear based upon this specification.

Particle size diameters, for purposes of this specification, are determined by the methods for determining particle size which are disclosed in books such as *Particle Size Analysis* by John D. Stockham and Edward G. Fochtman, Ann Arbor Science Publishers, Ann Arbor, Mich., 1977, and *Particle Size Analysis* by M. J. Groves, Heyden and Son, Inc., Phildelphia, Pa. The method of determining particle size diameters for particles used in this invention is based on the technique of laser light scattering. This technique is discussed in publications such as "Rapid Analysis of Particle Size Distributions by Laser Lights Scattering" by E. L. Weiss and H. N. Flock, *POWER TECHNOLOGY*, 14, 287-293 (1976), and "Light Scattering Measurements of Particle Distributions" by A. L. Wertheimer and W. L. Wilcock, American Optics, 15, 1616-1620 (1976). Instruments based on this principal, called a Microtrack Particle Size Analyzer, are manufactured by Leeds and Northrup, North Wales, Pa.

The percent by weight of a particular component in a composition is, throughout this specification, claims and examples, based upon the total weight of the composition, unless expressly stated otherwise.

Broadly, one embodiment of this invention involves a gear oil composition comprising: about 60 to about 85 percent by weight, as based upon the total weight of the composition, of a base oil; about 0.5 to about 5.0, and more preferably about 1 to about 4, and still more preferably about 2 to about 3 percent by weight, as based upon the total weight of the composition, of graphite particles, at least 90% by weight thereof, are 1 micron or less in particle size, and preferably at least 95% by weight thereof, 1 micron or less, wherein the 90% and 95% by weight thereof is based upon the total weight of graphite particles present in the composition; about 4 to about 10, and preferably about 5 to about 8 percent by weight, as based upon the total weight of the composition, of an extreme pressure additive; and at least an effective dispersant amount of an ethylene-propylene copolymer grafted with a nitrogen-containing vinyl functionality (hereinafter referred to as the "vinyl grafted copolymer"). Optionally, other additives to provide useful properties to the gear oil composition may be included. Such additives comprise antioxidants, metal deactivators, pour point depressants, oiliness agents, blooming agents, and peptizing agents.

By an effective dispersant amount of the vinyl grafted copolymer is meant that minimal amount in weight percent, based upon the total weight of the composition, of the vinyl grafted copolymer which sufficiently stabilizes the composition for use as a gear oil. To some degree, depending upon the inherent stability of the EP package and the severity of use conditions, the effective dispersant amount of the vinyl grafted copolymer will vary.

Based upon a use condition that occurs in the rear differential gear train of an automobile, we have found, as shown in Examples 3 and 4, that at least about 5 percent by weight, as based upon the total composition, is required and at least about 10 percent is to be preferred.

Generally, about 5 to about 20 percent by weight is useful and about 10 to about 18 percent preferred for most use applications. Generally, as the concentration of the vinyl grafted copolymer increases, there is an increasing improvement in gear oil stability against agglomeration and thickening during use. However, a concentration in excess of about 20 percent by weight, based upon the total weight of the composition, of the vinyl grafted copolymer does not provide any significant additive benefits with respect to the stabilizing of the gear oil composition against agglomeration and thickening.

The choice of a base oil is in part dependent upon the viscosity of the final gear oil composition desired. Viscosity is an important characteristic of gear oils, especially those compounded with extreme pressure additives. The lubricant viscosities of gear oils are restricted to relatively narrow ranges by two conflicting factors arising out of the use requirements of gear oil lubricants. These two factors are prevention of metal-to-metal contact of gear teeth mating surfaces and prevention of excessive viscous drag of the lubricant because of excessively high viscosity at particular operating temperatures. The former factor requires high viscosity, while the latter factor is best served with lower viscosities, which aid heat transfer.

Base oils suitable for the preparation of dispersions of this invention include all base oils commonly used for the production of engine oils, industrial oils, and other lubricating oils and lubricants. The choice of base oil is dependent mainly on the finished lubricant in question. For engine oils, paraffinic base oils such as those produced by solvent extraction and hydrogenation processes are preferred owing to their higher viscosity index and greater oxidation resistance. For industrial oils, naphthenic base oils are often preferred on account of their greater solubility for additives, lower cost, etc. Alternately, synthetic base oils such as polyalphaolefins, dibasic acid esters or neopentylpolyol esters can be used where exceptional low temperature fluidity, long service life, higher viscosity index with lower volatility, cleanliness, etc., justify their higher cost.

When high viscosity and low volatility are required, oils which are commonly called bright stocks can be used.

Examples of paraffinic oils include solvent treated neutral oils having viscosity of 100–600 SUS Saybolt Universal Seconds) at 100° F., and VI (viscosity index) of 85–120. Base oils having similar viscosity characteristics, but produced by the newer hydrocracking-hydrotreating processes, can also be used.

Examples of naphthenic oils include what are commonly called pale oils of 60–2000 SUS at 100° F. and VI of 0–60. This includes naphthenic oils which have been twice hydrogenated to remove aromatic components and to improve color and stability.

Examples of bright stocks include base oils having viscosity of 2000–8000 SUS at 100° F. and VI of 60–100.

Examples of synthetic base oils include polyalphaolefins having viscosity of 2.5–10 centistokes at 210° F., di-2-ethyl hexyl azelate, di-isodecyl adipate, di-tridecyl adipate, trimethylpropane n-heptanoate, neopentylglycol pelargonate, and the like.

The choice of base oil is also dependent on the viscosity of the dispersion desired. In general, the dispersion should not be too viscous to impair its handling characteristics. This includes pumping, filtration, centrifugation, other purification operations, and blending operations. The preferred viscosity of a dispersion containing 10% graphite and used for engine oils is in the range of 100–500 centistokes at 100° F. Although viscosity of the dispersion can be controlled by a number of factors such as particle size and dispersant concentration, the viscosity of the base oil has a definite effect on the viscosity of the dispersion.

Examples of EP additives suitable for use in this invention are EP additives containing sulfur and phoshorus as the active ingredients. These EP additives are commercially available from Edwin Copper, Inc., St. Louis, Mo.; Lubrizol Corporation, Wickliffe. Ohio; and Elco Corporation, Cleveland, Ohio.

Methods for making EP additives involved in this invention can be found in the following U.S. Pat. Nos.: 4,204,969 (1980) (assigned to Edwin Cooper, Inc.); 3,655,566 (1972), 4,119,549 (1978), 4,119,550 (1978), 4,191,659 (1980) (assigned to The Lubrizol Corporation); 4,166,795 (1979), 4,166,796 (1979), and 4,166,796 (1979) (assigned to Suntech, Inc.); and 4,125,471 (1978) (assigned to Standard Oil Company of Indiana). All of the patents cited hereinabove are expressly incorporated herein by reference.

The vinyl grafted copolymer of this invention broadly includes copolymers of at least two olefins such as ethylene and propylene (hereinafter referred to as the "ethylene-propylene copolymers"), and optionally less than 10% by weight, as based upon the total weight of the polymer, of a nonconjugated diene (hereinafter referred to as the "ethylene- propylene diene modified terpolymer") to which a polar monomer of a nitrogen-containing vinyl functionality such as N-vinyl pyrrolidones or C-vinyl pyridines have been graft polymerized. Methods for preparing such polymers are disclosed in U.S. Pat. No. 4,146,489 (1979), which is expressly incorporated herein by reference. Preferably, the backbone of these polymers is an oil soluble, substantially linear, rubbery hydrocarbon polymer involving reaction end products of ethylene and propylene or ethylene, propylene and a nonconjugated diene.

The ethylene-propylene copolymers may have a wide range of ethylene-propylene ratios. Above about 80 mole percent ethylene, the copolymers are partially crystalline, thus losing their oil solubility and their utility as substrates for this invention. Preferably, the ethylene-propylene substrates contain about 50 to about 70 mole percent ethylene, have viscosity average molecular weight of about 10,000 to about 200,000 and average Molecular Weight (by weight)/Molecular Weight (by number) of less than 4. Lower propylene contents, higher molecular weights, and broader molecular weight distributions can be used, but such copolymers lead to generally less efficient VI improvers.

The ethylene-propylene diene modified terpolymers are well known materials containing low levels (preferably less than 10% by weight) of a nonconjugated diene such as 1,4-hexadiene, dicyclopentadiene or ethylidene norbornene. Maximum ethylene is determined by crystallinity (solubility) with the preferred range being about 45 to about 65 mole percent ethylene. Preferred viscosity average molecular weight is about 10,000 to about 200,000 with Molecular Weight (by weight)/Molecular Weight (by number) of less than 8. Polymers outside of these ranges can be used at some sacrifice in properties of the VI improver made therewith.

The preferred monomer which is grafted to the olefinic backbone is 2-vinylpyridine. However, N-vinyl pyrrolidone or other polar C-vinylpyridines may be used such as 2-vinylpyridine, 4-vinylpyridine, and lower alkyl ($C_1$–$C_8$) substituted C-vinylpyridines such as 2-methyl-5-vinylpyridine, 2-methyl-4-vinylpyridine, 2-vinyl-5-ethyl pyridine, and 2-vinyl-6-methylpyridine.

Other polar nitrogen-containing grafting monomers may be used in minor amounts with N-vinyl pyrrolidone or the C-vinylpyridines. These include dimethylaminoethyl methacrylate or acrylate, vinylimidazole, N-vinylcarbazole, N-vinylsuccinimide, acrylonitrile, o-, m-, or p-aminostyrene, maleimide, N-vinyl oxazolidone, N,N-dimethylaminoethyl vinyl ether, ethyl 2-cyanoacrylate, vinyl acetonitrile, N-vinylphthalimide, and 2-vinylquinoline; a variety of acrylamides and methacrylamides such as N-[1,1-dimethyl-3-oxobutyl] acrylamide, N-[1,2-dimethyl-1-ethyl-3-oxobutyl] acrylamide, N-(1,3-diphenyl-1-methyl-3-oxopropyl) acrylamide, N-(1-methyl-1-phenyl-3-oxobutyl) methacrylamide, N,N-diethylaminoethyl acrylamide, and 2-hydroxyethyl acrylamide. A variety of N-vinylcaprolactams or their thio-analogs, other than or in addition to N-vinylpyrrolidone, may be used in minor amounts. These include N-vinylthiopyrrolidone, 3-methyl-1-vinylpyrrolidone, 4-methyl-1-vinylpyrrolidone, 5-methyl-1-vinylpyrrolidone, 3-ethyl-1-vinylpyrrolidone, 3-butyl-1-vinylpyrrolidone, 3,3-dimethyl-1-vinylpyrrolidone, 4,5-dimethyl-1-vinylpyrrolidone, 5,5-dimethyl-1-vinylpyrrolidone, 3,3,5-trimethyl-1-vinylpyrrolidone, 4-ethyl-1-vinylpyrrolidone, 5-methyl-5-ethyl-1-vinylpyrrolidone, 3,4,5-trimethyl-3-ethyl-1-vinylpyrrolidone, and other lower alkyl substituted N-vinylpyrrolidones; N-vinylbenzyldimethylamine, N-dimethyl-aminopropyl acrylamide and methacrylamide, N-methacryloxyethylpyrrolidone, N-methacryloxyethylmorpholinone, N-methacryloxy-ethylmorpholine, N-maleimide of dimethylaminopropylamine, and the N-methacrylamide of aminoethylethyleneurea. "Minor amounts" of such graft monomers means less than 50% by weight of the monomer charge; for example, about 10–30% by weight of the charge.

Any free radical source capable of hydrogen abstraction may be used as a catalyst (initiator) in the preparation. Examples are alkyl peroxy esters, alkyl peroxides, alkyl hydroperoxides, diacyl peroxides, and the like. While t-butyl perbenzoate is the preferred initiator, other examples which would be suitable include t-butyl peroctoate, di-tibutylperoxide, t-butyl-hydroperoxide, cumene hydroperoxide, or benzoyl peroxide. Any mixtures of such initiators may be used.

The following examples disclosing specific embodiments of the invention of this specification are intended to be illustrative only. Variations on these embodiments are clear to a person of skill in the art and such variations are intended to be included to the extent they are disclosed by the general teachings of this specification, and those teachings commonly known in the relevant art.

EXAMPLE 1

In this Example, a gear oil containing 1% by weight of graphite increased during use in viscosity to an unacceptable degree. The gear oil composition tested consisted of a 150 SUS base oil plus 1% by weight of graphite having 95% of the particle size of graphite, based on the weight of graphite present, less than 1 micron, plus 9% by weight of a copolymer of an N-vinyl pyrrolidone and an oil soluble acrylic ester having a molecular weight of about 900,000, wherein the mole ratio of N-vinyl pyrrolidone to oil soluble acrylic ester is about 1 to 10.

A 1976 Chevrolet Nova using this graphited gear oil composition was run so as to accumulate up to 59,000 miles, both by highway driving and on a mileage accumulating dynamometer (MAD). After the initial 2,000 moles of mileage accumulation, primarily by highway driving, there was no observed problem. However, at about 59,000 miles, there was a bearing leakage failure attributed to thickening of the gear oil lubricant. This thickening was confirmed, as shown in the following table:

TABLE 1

| Viscosity | Initial | Final |
|---|---|---|
| 210° F. | 14.29 cSt | 395 cSt |
| 100° F. | 144.5 cSt | 1,300 cSt |
| Minus 26° C. | 83,000 cPs | 570,000 cPs |

cSt = centistokes
cPs = centipoise

A 1978 Chevrolet Caprice was run to confirm these results. The results were confirmed by a graphited gear oil which at 210° F. increased in viscosity from an initial value at 14.97 cSt to 76 cSt at about 15,000 moles and to 119 cSt at about 25,000 miles. As a control, the base oil without graphite was run; the initial 14.97 cSt viscosity of the base oil at 210° F. without graphite increased to only 31 cSt after 25,000 miles. The thickening expected solely from oxidation of the base oil was demonstrated to be insufficient to explain the extreme thickening observed in the case of the graphited gear oil. This Example indicates that a particle-containing gear oil composition has a greater sensitivity to thickening than a gear oil not containing particles.

EXAMPLE 2

This Example discloses that ther is a correlation between the amount of EP package breakdown and both agglomeration and thickening. A 75W90 gear oil, both with and without an EP additive package, was tested. The first composition consisted of 3% by weight graphite, 27% by weight ethylene-propylene N-vinyl pyrrolidone polymer, 70% by weight of a base oil. The second composition was the same as the first, except that some of the base oil was replaced by 7.4% by weight of a sulfur-phosphorus EP package of Anglamol 6020, a commercially available EP package. Each of these compositions was heated on a hot stage at a rate of 3° F. per minute. In the composition without any EP package, no agglomeration was observed up to a temperature of 400° F. However, the composition containing an EP package was found to have agglomeration evidencing itself at about 320° F. This agglomeration became more extensive as the temperature was increased to 400° F. This experiment clearly demonstrated that the thickening in particulate containing compositions was related to the presence of an EP package.

In a follow-up experiment, a gear oil composition comprising 2% by weight graphite, 18% by weight of an ethylene-propylene N-vinyl pyrrolidone polymer, 5.25% by weight of an S/P EP package, Hitec E-320, a commercially available EP package, and 74.75% by weight of a base oil was stored at two temperatures in an oven. The first temperature was 325° F. and the second temperature was 250° F. It was found, in a very short period of time of not more than two to three days, that there was substantially more thickening at 325° F. than at 250° F. It was also found that the intensity of sulfur odor observed increased dramatically with temperature, suggesting that, at the higher temperature, there was a greater degree of breakdown in the EP package than at the lower temperature. This suggests that there is a correlation between the amount of EP package breakdown and thickening.

EXAMPLE 3

Four 80W90 gear oils were tested in the rear differential of a 1979 Chevrolet station wagon. These blends are given in the following table:

| % by Weight | Base Composition 80W90 | A | B | C |
|---|---|---|---|---|
| EP | 7.4(s/p) | 7.4 | 5.25 | 5.25 |
| Graphite | 0 | 1 | 1 | 1 |
| Base Oil | 90.8 | 85.8 | 88 | 88 |
| Dispersant | 0 | | | |
| Acryloid 940 | | 4 | | |
| SLA 1155 | | | 4 | |
| Acryloid 957 | | | | 4 |
| Pour Depressant | 1.8 | 1.8 | 1.8 | 1.8 |

In a dynamometer test which ranged from 0 to 15,000 miles, the viscosity at 210° F. of 80W90 increased from 15 centistokes (cSt) to 24 cSt; Composition A increased from 15 to 220 cSt; Composition B increased from 15 to 50 cSt; and Composition C increased from 15 to 95 cSt. These viscosity readings are the result of measuring before and after the dynamometer registered 15,000 miles. The result for composition B is based on an extrapolation to 15,000 of data taken only up to 11,000.

EXAMPLE 4

Sufficient graphite properly dispersed in a gear oil will provide surprising improvements in energy efficiency, e.g., improved gas mileage, and a significant decrease in wear.

To establish these benefits, a test was designed to specifically evaluate the significance of high, medium and low levels of both graphite and dispersant. By high, medium and low levels of graphite, for purposes of Example 4, is meant 1%, 1.5%, and 2% by weight graphite, respectively. By low, medium and high levels of dispersant is meant, for purposes of this Example 4, 10%, 14%, and 18% by weight dispersant, respectively. All gear oils used were blended to have an 80W90 SAE viscosity. This was done to eliminate viscosity variations as a potential factor in energy efficiency. Six blends were used and these are given in the following table.

| | Base Case 80w90 | A *low/low | B *low/high | C *medium/medium | D *high/low | E *high/high |
|---|---|---|---|---|---|---|
| % by wt. Base Oil | 90.8 | 78.5 | 74.5 | 71.5 | 68.5 | 64.5 |
| % by wt. EP | 5.25 | 5.25 | 5.25 | 5.25 | 5.25 | 5.25 |
| % Pour Depressant | 1.8 | 0.25 | 0.25 | 0.25 | 0.25 | 0.25 |
| Dispersant | | 10 | 18 | 14 | 10 | 18 |
| % by wt. Graphite | 0 | 1 | 1 | 1.5 | 2 | 2 |

*Graphite/Dispersant

After each car had been driven for 7,500 miles and 15,000 miles, respectively, the miles per gallon was determined for each car on a dynamometer. A modified EPA gas mileage cycle was used. The cycle that was used is identical to the EPA cycle and was only modified in that, instead of heat soaking and air conditioning, the car was instead merely run through a warm-up cycle prior to the test. The warm-up consisted of a portion of the highway EPA cycle, which was run prior to the city cycle, which was then followed by the highway cycle, which was then followed by the city cycle, and then the highway cycle.

To insure the significance of the resuls, an analysis of variance was determined on the miles per gallon data. All cases were run twice to determine empirically the amount of variation in miles per gallon observed.

Figure 2:
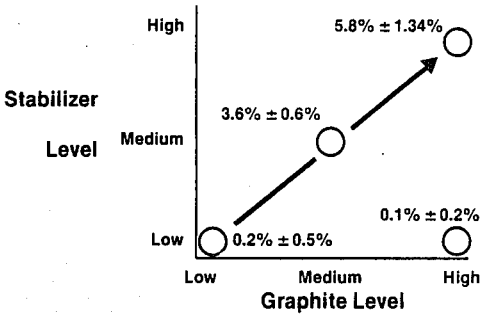
Figure 3:
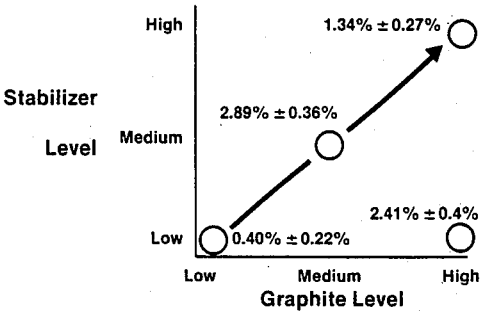
Figure 4:
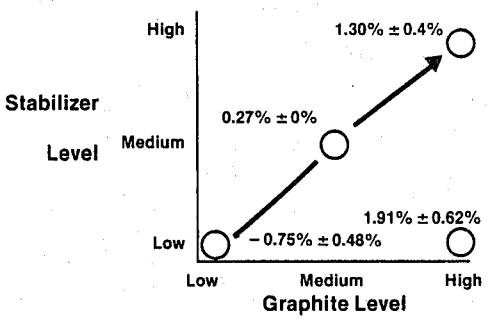

From the graphs of FIGS. 1, 2, 3 and 4 for the percent improvement in miles per gallon at 7,500 and at 15,000, the impact of high, medium and low levels of concentration for both stabilizer and graphite are plotted. FIGS. 1 and 2 are plots of results from the EPA Fuel Economy Test-City Cycle, and FIGS. 3 and 4, EPA Fuel Economy Test-Highway Cycle. Two significant points are made clear: (1) the standard deviation (shown as a plus or minus number) is sufficiently small to establish the significance of the observed percent improvement in miles per gallon; and (2) to obtain the benefits from graphite dispersion at the 15,000 mile and above level, there are two things required: (i) the amount of dispersant must be sufficient to avoid agglomeration and thickening; and (ii) the level of graphite must be sufficient. To assess the wear benefits available from the various gear oil compositions, the level of iron (Fe) in parts per million (ppm) in samples of used oil was determined. The same gear oil was used throughout. However, samples at 4,000, 7,500 and 15,000 miles were taken and used to determine the parts per million iron present. The ppm Fe in the oil at 4,000 miles is given in the following table. However, only the amount of increase in ppm Fe at 7,500 over that ppm of Fe at 4,000 and the increase in ppm of Fe at 15,000 over that ppm of Fe at 4,000 are reported.

| Iron Wear Metals (Δ from 4,000 Mile Level) | ppm Fe @ 4,000 mi. | Δ Fe Increase to 7,500 mi. | Δ Fe Increase to 15,000 mi. |
|---|---|---|---|
| 80W90 Base Case | 138 | 27 | 68 |
| A | 167 | 14 | 0 |
| B | 251 | 14 | 87 |
| C | 118 | 1 | 5 |
| C | 220 | 30 | 13 |
| D | 131 | 1 | 0 |
| E | 91 | 15 | 25 |

The above table, entitled "Iron Wear Metals (Δ from 4,000 Mile Level)," indicates that the amount of wear is significantly reduced in the case of the graphited blends versus the ungraphited blends.

The invention claimed is:

1. An energy efficient lubricating composition suitable for lubricating gears comprising:

(a) about 60% to about 85% by weight of a base oil;

(b) about 0.5% to about 5.0% by weight of graphite particles wherein at least 90% by weight of said particles, based upon the total weight of said particles, is no greater than one micron in particle size;

(c) an effective dispersant amount of an ethylene-propylene copolymer grafted with a nitrogen-containing vinyl functionality selected from the group consisting of an N-vinyl pyrrolidone and a C-vinyl pyridine.

(d) about 4% to about 10% by weight of a sulfur- and phosphorus-containing EP additive; wherein the percent by weight of all components added together equals 100%.

2. The composition of claim 1 wherein the copolymer of at least two olefins comprises an oil soluble substantially linear, rubbery hydrocarbon polymer formed from reaction products of one of two groups of reactants consisting of: (i) ethylene and propylene reacted to form a group (1) polymer; and (ii) ethylene, propylene and a nonconjugated diene reacted to form a group (2) polymer; wherein the mole percent of ethylene in said group (1) polymer is in the range of about 50 to about 70 mole percent, and wherein the mole percent of ethylene in said group (2) polymer is in the range of about 45 to about 68 mole percent.

3. The composition of claim 1 or 2 wherein the effective dispersant amount of the vinyl grafted copolymer is in the range of about 5% to about 20% by weight.

4. The composition of claim 3 wherein the range in percent by weight of the graphite particles is about 1% to about 4%; of the EP additive, about 5% to about 8%; and of the vinyl grafted copolymer, about 10% to about 18%.

* * * * *